US007409959B2

(12) United States Patent
Retsema

(10) Patent No.: US 7,409,959 B2
(45) Date of Patent: Aug. 12, 2008

(54) DISHWASHER AND MOTOR CAVITY SOUND ATTENUATOR

(75) Inventor: Andrew James Retsema, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 510 days.

(21) Appl. No.: 10/698,153

(22) Filed: Oct. 29, 2003

(65) Prior Publication Data

US 2005/0092353 A1 May 5, 2005

(51) Int. Cl.
*B08B 13/00* (2006.01)

(52) U.S. Cl. ..... 134/56 D; 134/57 D; 134/200; 134/201

(58) Field of Classification Search ..... 134/56 D, 134/57 D, 58 D, 200, 201
See application file for complete search history.

(56) References Cited

U.S. PATENT DOCUMENTS

| | | | | | |
|---|---|---|---|---|---|
| 2,254,837 | A | * | 9/1941 | Burns | 62/296 |
| 2,958,911 | A | * | 11/1960 | Bertram et al. | 52/792.1 |
| 3,292,645 | A | * | 12/1966 | Braden et al. | 134/57 D |
| 3,295,541 | A | * | 1/1967 | Ummel | 134/182 |
| 3,458,241 | A | * | 7/1969 | Barnard et al. | 312/228 |
| 3,529,881 | A | * | 9/1970 | Kaldenberg | 312/276 |
| 4,985,106 | A | * | 1/1991 | Nelson | 156/276 |
| 4,989,252 | A | * | 1/1991 | Nakanishi et al. | 381/71.3 |
| 5,056,341 | A | * | 10/1991 | Mori et al. | 68/3 R |
| 5,129,003 | A | * | 7/1992 | Saruta | 381/71.3 |
| 5,158,346 | A | * | 10/1992 | Marks et al. | 312/204 |
| 5,168,621 | A | * | 12/1992 | Kruck et al. | 29/451 |
| 5,515,702 | A | * | 5/1996 | Park | 68/3 R |
| 5,549,760 | A | * | 8/1996 | Becker | 134/25.2 |
| 5,741,054 | A | * | 4/1998 | Becker et al. | 312/228 |
| 5,744,213 | A | * | 4/1998 | Nelson | 428/131 |
| 5,755,900 | A | * | 5/1998 | Weir et al. | 156/62.2 |
| 5,841,081 | A | * | 11/1998 | Thompson et al. | 181/286 |
| 5,965,851 | A | * | 10/1999 | Herreman et al. | 181/200 |
| 6,512,831 | B1 | * | 1/2003 | Herreman et al. | 381/71.3 |
| 6,539,955 | B1 | | 4/2003 | Tilton et al. | 134/58 |
| 6,764,147 | B2 | * | 7/2004 | Flowers | 312/228 |
| 6,827,894 | B1 | * | 12/2004 | Tilton et al. | 264/138 |
| 6,955,845 | B1 | * | 10/2005 | Poole et al. | 428/76 |
| 7,041,377 | B2 | * | 5/2006 | Miura et al. | 428/442 |
| 2004/0206377 | A1 | * | 10/2004 | Griffin et al. | 134/56 D |
| 2005/0076938 | A1 | * | 4/2005 | Jordan et al. | 134/183 |

FOREIGN PATENT DOCUMENTS

| | | | |
|---|---|---|---|
| DE | 198 58 002 | * | 6/2000 |
| FR | 2 432 196 | * | 2/1980 |
| GB | 2 290 948 | * | 1/1996 |
| JP | 2000-126107 | * | 5/2000 |

OTHER PUBLICATIONS

European Patent Office 0 459 875 Dec. 1991.*

* cited by examiner

*Primary Examiner*—Frankie L Stinson
(74) *Attorney, Agent, or Firm*—John Morrison; Michael D. Lafrenz

(57) ABSTRACT

A dishwasher with a sound attenuator for attenuating the sound emanating from a motor cavity of the dishwasher. The sound attenuator comprising a sound absorber and a sound barrier. The sound absorber absorbing sound in the motor cavity with the sound barrier blocking the unabsorbed sound from escaping.

14 Claims, 6 Drawing Sheets

DISHWASHER AND MOTOR CAVITY SOUND ATTENUATOR

BACKGROUND OF THE INVENTION

1. Field of the Invention

This invention relates to an automatic dishwasher comprising a wash tub supported above a floor to form a motor cavity in which a motor, pump, and related dishwashing components are located. In one aspect, the invention relates to a sound attenuator comprising a sound barrier and a sound absorber installed along the motor cavity for attenuating sound emanating from the motor cavity during dishwasher operation. In another aspect, the invention relates to a sound absorber installed along the motor cavity for absorbing sound emanating from the motor cavity.

2. Description of the Related Art

Automatic dishwashers are well known, especially those for use in household environments. A typical automatic dishwasher comprises a washing chamber or wash tub that is supported in a frame and installed under a countertop. The frame supports the wash tub above the floor so that a motor chamber is formed beneath the bottom of the wash tub and the floor. This motor chamber typically houses components such as a motor, a pump, water supply and drain lines, electrical supply lines, and the like. The motor chamber is typically closed after installation of the dishwasher by an access panel.

The operation of the components frequently generate noise that can migrate from the motor chamber, even with the access panel installed. Prior attempts to attenuate the sound include the use of fibrous insulation mounted to the rear of the access panel. However, even with the fibrous insulation, the noise can still be loud enough to interfere with other activities conducted nearby, such as mealtime conversation, telephone use, or listening to a radio or television. The fibrous insulation permits some sound to make it to the access panel and into the room by gaps around the access panel or causing the vibration of the access panel.

It is desirable to have an automatic dishwasher that has a sound attenuator that can effectively control the sound generated by components located in the motor chamber. Since previously sold dishwashers do not have any sound attenuation or have inadequate sound attenuation, it is highly desirable to have a sound attenuator that can be added during the manufacturing of new machines as well as being retrofitted to already manufactured and installed dishwashers.

SUMMARY OF THE INVENTION

In one aspect, the invention relates to a dishwasher having an insertable sound attenuator to reduce the sound emanating from a motor cavity. The dishwasher comprises a wash tub comprising a rear wall, top wall, bottom wall, and side walls, with the walls collectively forming an open-faced wash chamber. A support frame mounts the wash tub and has a front-facing opening intermediate a support frame upper portion and a support frame lower portion. The open-faced wash chamber is in communication with the front-facing opening, and the motor cavity, with a front-facing motor cavity opening, is defined intermediate the wash tub bottom wall and the support frame lower portion. The sound attenuator comprises one of a sound barrier element and a sound absorbing element. The attenuator substantially closes the motor cavity opening to attenuate the sound emanated from the motor cavity through the motor cavity opening.

The sound barrier element can comprise a sheet-like body. The sheet-like body can have a planar central portion adapted to be inserted into the motor cavity. At least one lateral wing portion can be hingedly attached to the central portion and adapted for vertical installation along the sides of the motor cavity. An insulation curtain can be mounted to the wash tub and extend along at least one side of the support frame and terminating in an edge adjacent the motor cavity, where the wing portion will overlap the insulation curtain.

The sound barrier element is preferably made of a mass loaded vinyl, whereas the sound absorbing element comprises a fibrous polyester. A fastener is preferably used to connect the sound barrier element to the front panel portion. The fastener can be a mechanical fastener, adhesive, or some other suitable fastener.

An access panel can be mounted to the support frame in overlying relationship with the sound barrier and the motor cavity opening.

In another aspect, the invention relates to a method of installing a motor cavity sound attenuator in an automatic dishwasher. The automatic dishwasher comprises a wash chamber supported on a support frame above a motor cavity having a front-facing motor cavity opening that is closed an access panel. The method comprises: providing a sound attenuator comprising a sound barrier and a sound absorber; and positioning the sound attenuator to cover the motor cavity opening.

The positioning of the sound attenuator can further comprise positioning a portion of the sound attenuator along a bottom portion of the motor cavity. Additionally, a portion of the sound attenuator can be positioned against a side portion of the motor cavity. The portion of the sound attenuator can overlap a portion of an insulation element extending along the side of the motor cavity. The positioning of the sound attenuator can further comprise positioning a second portion of the sound attenuator along a bottom portion of the motor cavity. The sound attenuator is preferably positioned such that the sound absorber faces the motor cavity.

The method can further comprising the step of removing the access panel to expose the motor cavity. Similarly, the method can include the replacing the access panel over the front portion of the motor cavity after inserting the motor cavity sound attenuator into the motor cavity to conceal the motor cavity sound attenuator.

DESCRIPTION OF AN EMBODIMENT OF THE INVENTION

Figure 1:
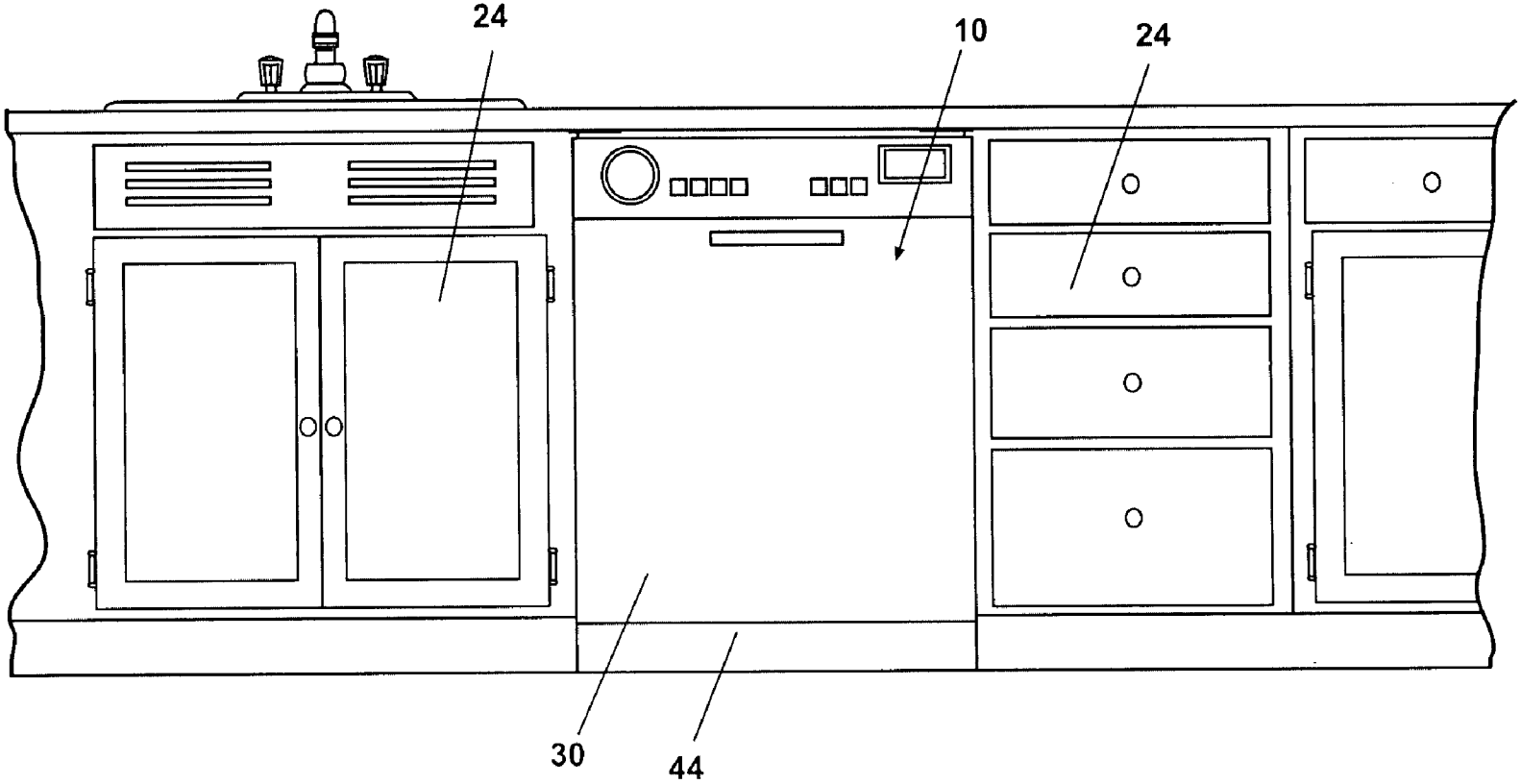
FIG. 1 is an elevational view of a built-in type automatic dishwasher according to the invention in a household installation.
Figure 2:
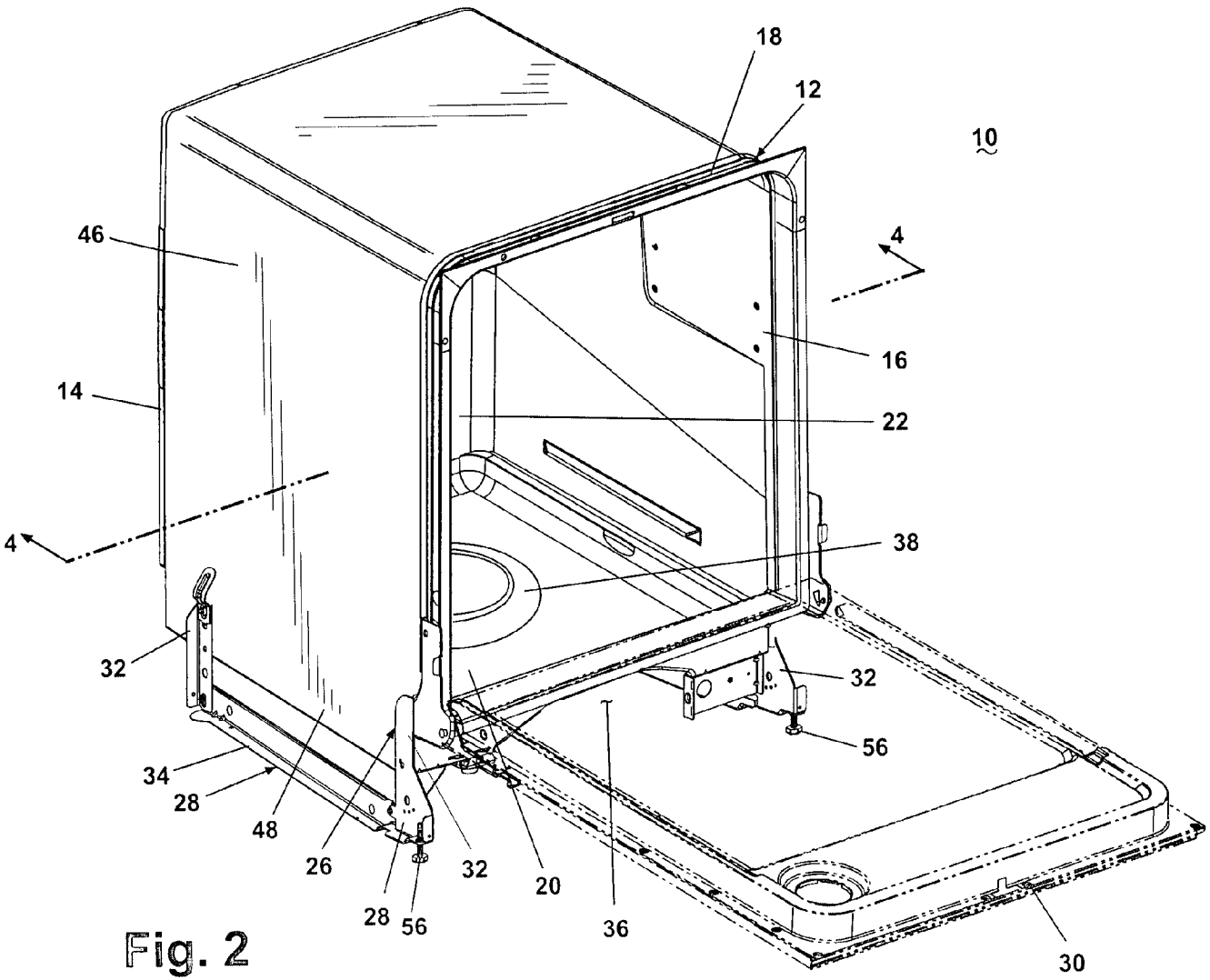
FIG. 2 is a perspective view of the automatic dishwasher of FIG. 1 showing a wash tub supported in a frame to define a motor cavity beneath the wash tub.

FIGS. 1 and 2 illustrate an automatic dishwasher 10 comprising an open-faced wash tub 12 having side walls 14, 16, whose upper and lower ends are connected by a top wall 18 and a bottom wall 20, respectively, and all of which extend away from a rear wall 22. Access to the washtub 12 is obtained through a front opening, which is closed by a door 30 hingedly mounted for movement between an open position (FIG. 2), wherein the door 30 is generally horizontal, to a closed position (FIG. 1), wherein the door 30 covers the access opening and seals the wash tub 12. The dishwasher shown in FIGS. 1 and 2 is a built-in type designed to be mounted within a cabinet system 24 and does not have an external or decorative cabinet.

Figure 3:
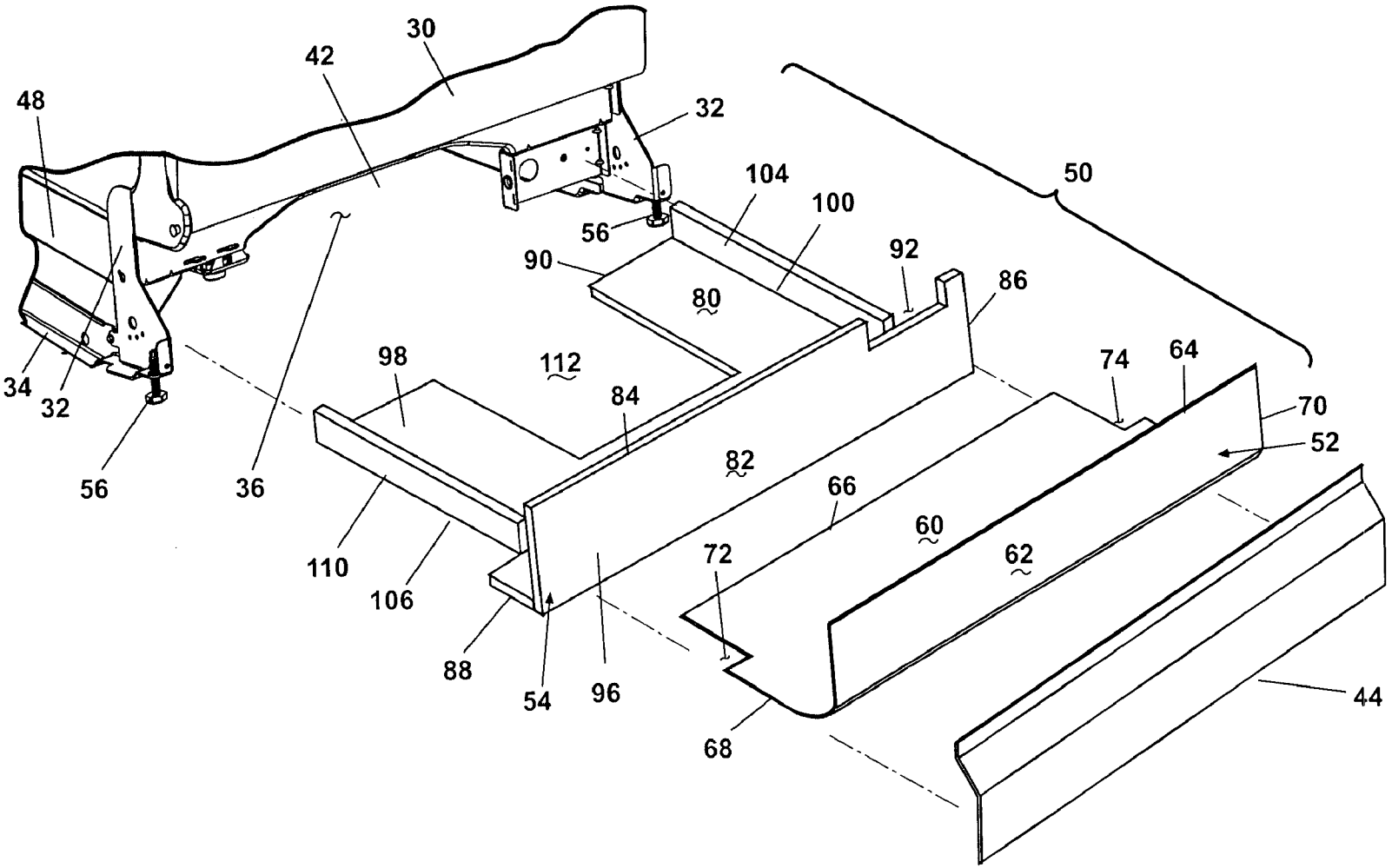
FIG. 3 is an enlarged exploded view of a lower portion of the automatic dishwasher of FIG. 1 illustrating a sound attenuator according to the invention for installation in the motor cavity.

The automatic dishwasher 10 further comprises a support frame 26 attached to and extending along the side walls 14, 16 and the top wall 18 to support the wash tub 12 in an elevated position relative to an underlying support surface, such as a floor. The support frame 26 terminates along each side wall 14, 16 in a support frame leg 28 extending downwardly from the bottom wall 20. The support frame leg 28 comprises an upper portion 32 adjacent the bottom wall 20, and a lower portion 34 comprising a foot 56. The support frame legs 28, the bottom wall 20, and the underlying support surface define a motor cavity 36 (FIG. 4) for housing dishwasher operational equipment, such as a motor 38, a pump 40, water supply and drain lines (not shown), and the like, suspended from the bottom wall 20 or interconnected through the rear wall 22. The motor cavity 36 has a forward-directed access opening 42 providing access to the motor cavity 36, which is closed with a removable access panel 44 (FIGS. 1 and 3). An insulation blanket 46 comprises a generally conventional insulating mat wrapped along the side walls 14, 16 and the top wall 18 intermediate the washtub 12 and the support frame 26. The insulation blanket 46 terminates below the side walls 14, 16 in a pair of insulation curtains 48 extending downwardly adjacent the support frame legs 28. This insulation blanket 46 is designed to provide thermal insulating and sound attenuation.

As shown also in FIG. 3 and as hereinafter described, a sound attenuator 50 is installed in the motor cavity 36 and over the access opening 42. The sound attenuator 50 comprises a sound barrier 52 for blocking the transfer of sound from the motor cavity and a sound absorber 54 for absorbing sound from the motor cavity. The sound absorber 54 absorbs sound emanating from the motor cavity and the sound barrier blocks the sound that is not absorbed from passing though the sound absorber and the access panel.

FIGS. 3-7 illustrate the sound attenuator 50 in greater detail. The sound barrier 52 is a generally rectilinear, sheet-like body having an obverse face 60 and a reverse face 62, an upper edge 64 and a lower edge 66 in parallel, spaced-apart juxtaposition, and a pair of side edges 68, 70 in parallel, spaced-apart juxtaposition extending between the upper edge 64 and the lower edge 66. A rectilinear notch 72 extends inwardly from the lower edge 66 along the side edge 68, and a rectilinear notch 74 extends inwardly from the lower edge 66 along the side edge 70. The sound barrier 52 is preferably fabricated of a dense, flexible material, such as a mass-loaded vinyl, having suitable sound-blocking properties for the purposes described herein. A suitable mass-loaded vinyl is made by American Acoustical Products of Massachusetts, with a thickness of ⅛ inch and a density of 1.2 lb/ft$^2$. The barrier is sized to extend across the access opening 42 between the support surface (i.e. the floor) and the washtub 12.

The function of the sound barrier is to block the transfer of sound from the motor cavity to the access panel. The density of the sound barrier results in very little to no vibration of the sound barrier in response to the sound waves in the motor cavity, thereby preventing the sound waves from reaching the access panel, which would otherwise vibrate and pass the sound into the room.

Figure 6:
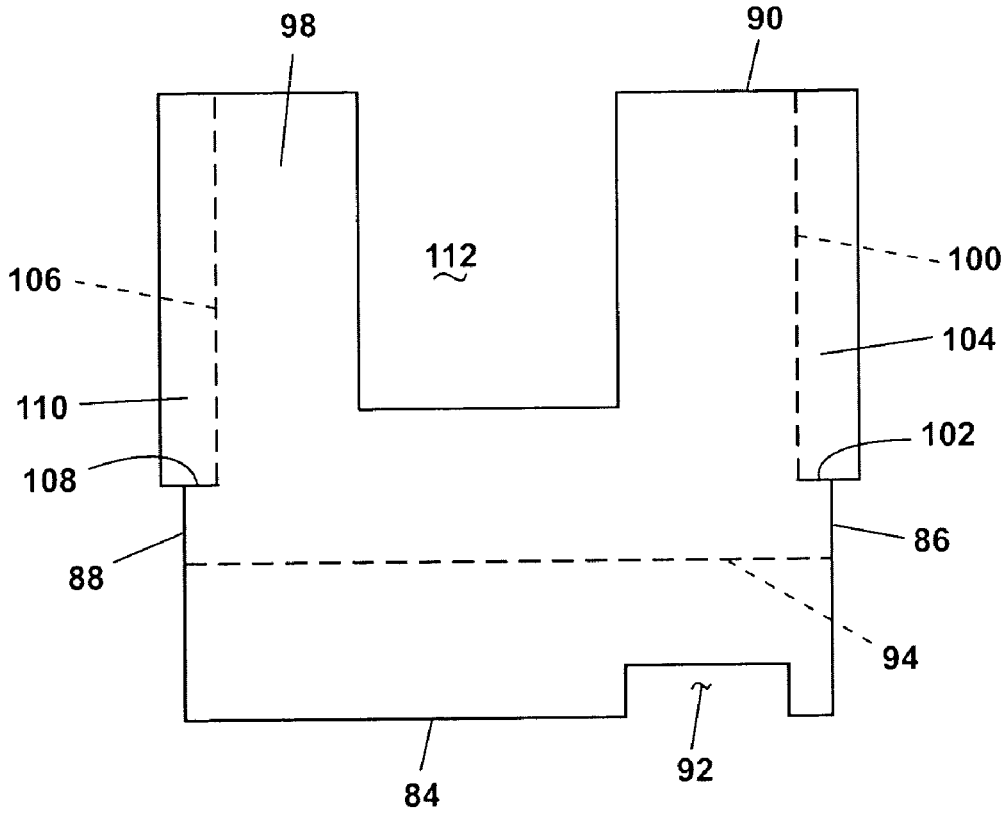
FIG. 6 is a plan view of the sound absorber shown in FIG. 5.
Figure 7:
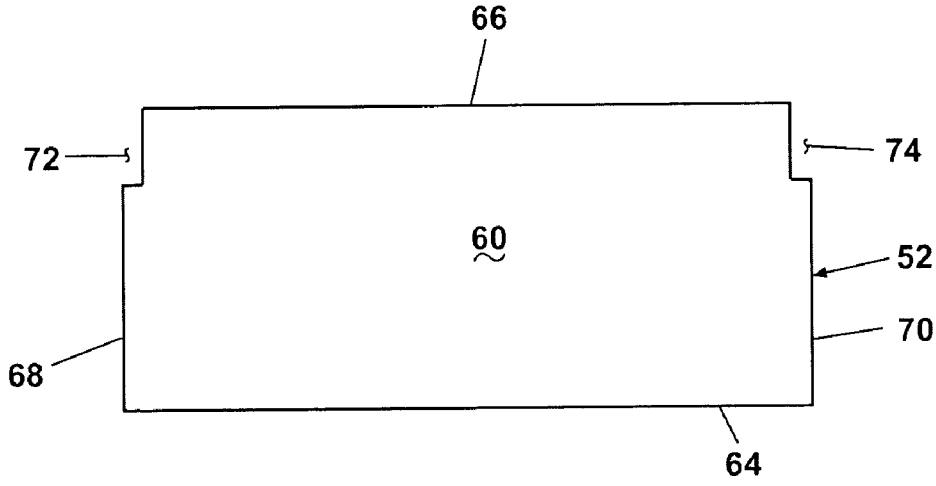
FIG. 7 is a plan view of the sound barrier shown in FIG. 5.

As shown in FIGS. 3 and 6, the sound absorber 54 is a generally rectilinear, sheet-like body having an obverse face 80 and a reverse face 82, a forward edge 84, a pair of parallel, spaced-apart side edges 86, 88, and a rear edge 90 in parallel, spaced-apart juxtaposition with the forward edge 84. The side edges 86, 88 extend between the forward edge 84 and the rear edge 90. The sound absorber 54 is preferably fabricated of a fibrous material, such as fibrous polyester, having suitable sound-absorbing properties for the purposes described herein, and is sized to extend into the motor cavity 36 between the support frame legs 28.

A suitable sound absorber is VersaMat sold by Owens Corning, which is ⅝ inch thick and has a density of 95 g/ft$^2$. The sound absorber functions to attenuate the sound waves in the motor cavity by the fibers of the sound absorber vibrating in response to the sound waves and dissipating the vibrations as heat.

A rectilinear notch 92 extends inwardly along the forward edge 84 adjacent to the side edge 86. The rectilinear notch 92 receives a float switch when assembled to the support frame. If the float switch is not present, the notch 92 is not needed.

A fold line 94 extends parallel to the forward edge 84 between the side edges 86, 88 to define a front panel 96 and a lower panel 98. The fold line 94 is adapted so that the front panel 96 can be folded orthogonal to the lower panel 98 to cover the access opening 42. A fold line 100 extends parallel to the side edge 86 from the rear edge 90 to a cut line 102 extending inwardly from the side edge 86 intermediate and parallel to the forward edge 84 and the rear edge 90 to define a wing panel 104. Similarly, a fold line 106 extends parallel to the side edge 88 from the rear edge 90 to a cut line 108 extending inwardly from the side edge 88 intermediate and parallel to the forward edge 84 and the rear edge 90 to define a wing panel 110. The fold lines 100, 106 are adapted so that the wing panels 104, 110 can be folded orthogonal to the lower panel 98.

Figure 5:
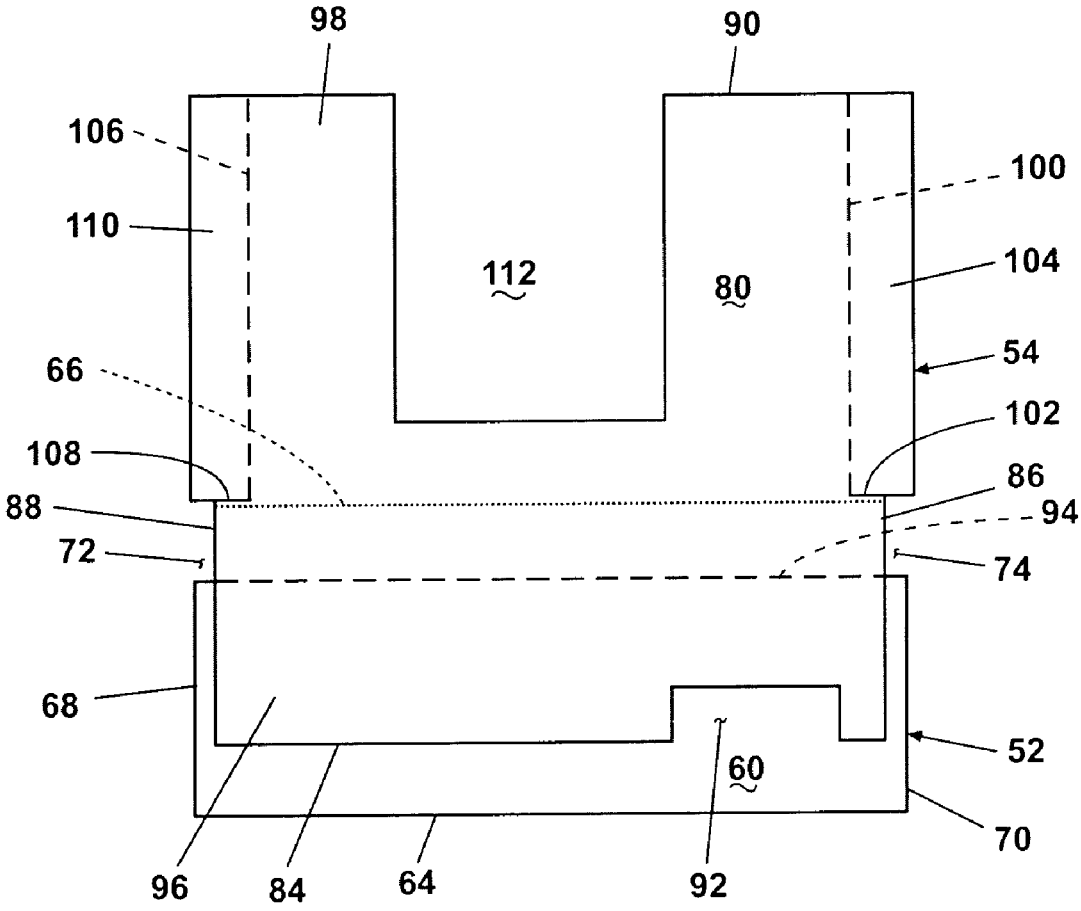
FIG. 5 is plan view of the sound attenuator shown in FIG. 3 assembled from a sound absorber and a sound barrier.

As shown in FIGS. 3 and 5, the sound barrier 52 is attached to the sound absorber 54 by bringing the obverse face 60 into cooperative register with the reverse face 82 so that the lower edge 66 extends between the side edges 86, 88 adjacent and parallel to the cut lines 102, 108, and the ends of the notches 72, 74 are collinear with the fold line 94. The side edges 68, 70 will extend laterally outwardly of the side edges 86, 88, and the upper edge 64 will extend laterally beyond the forward edge 84. The sound barrier 52 is fixedly attached to the sound absorber 54 on either side of the fold line 94 through suitable connecting means, such as staples, an adhesive, rivets, or other like fasteners.

Figure 4:
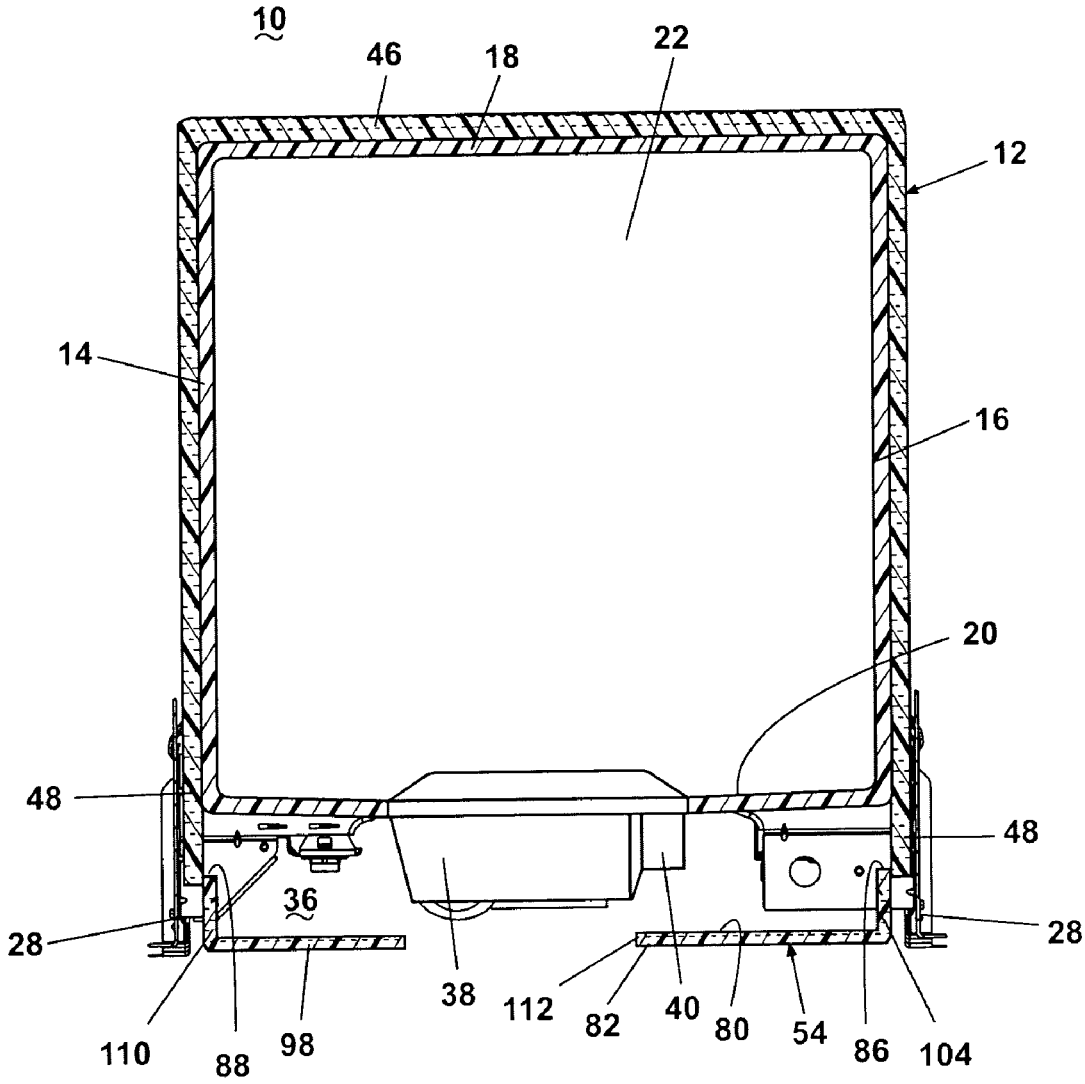
FIG. 4 is a cross-sectional view of the dishwasher of FIG. 2 taken along line 4-4 and showing the sound attenuator installed in the motor cavity.

Referring now to FIGS. 3 and 4, the sound attenuator 50 is installed in the motor cavity 36 as follows. The sound attenuator 50 is positioned horizontally with the rear edge 90 at the access opening 42, and with the obverse faces 80, 60 facing upwardly. The wing panels 104, 110 are folded upwardly along the cut lines 102, 108, respectively, as the sound attenuator 50 is inserted into the motor cavity 36 so that the wing panels 104, 110 are positioned interiorly of the insulation curtains 48, as shown in FIG. 4, which will retain the wing panels 104, 110 in a vertical position against the insulation curtains 48, thereby providing a continuous sound absorption layer along the sides of the motor cavity 36, which prevents sound from escaping below the bottom edge of the insulation curtain. The sound attenuator 50 is inserted into the motor cavity 36 until the front fold line 94 is generally coplanar with the front of the washtub 12. The front panel 96 and the sound barrier 52 are folded upwardly along the front fold line 94 to extend across the access opening 42. The side edges 68, 70 can be adapted to extend completely across the access opening 42 to engage the sides of adjoining cabinetry 24, thereby providing a complete sound barrier across the front of the motor cavity 36. Similarly, the sound barrier 52 will extend into the motor cavity 36 so that the lower edge 66 is located on the support surface somewhat interiorly of the access opening 42 so that the access opening 42 is completely covered by a sound barrier layer.

The access panel 44 is then installed to the dishwasher 10 in a conventional manner, such as through threaded fasteners threaded into the support frame 26 or suitable threaded receptacles provided on or adjacent to the washtub 12.

The sound attenuator 50 described herein comprises both a sound barrier and a sound absorber providing a high degree of sound attenuation generated by equipment operating within the motor cavity of an automatic dishwasher. The sound attenuator 50 is simple and inexpensive in design and fabrication, is easily installed, and can be readily transported in the washtub of the dishwasher. The sound attenuator 50 is also suitable as a retrofit sound attenuator for previously installed dishwashers.

In an alternate embodiment, the sound attenuator 50 comprises the sound absorber 54 without the sound barrier 52. This embodiment can be employed in dishwashers generating lower intensity sound, or where a higher degree of sound attenuation is not critical. In such a case, the sound absorber 54 is installed as previously described so that the front panel 96 extends across the access opening 42, followed by installation of the access panel 44. While the alternative embodiment lacks the benefits of the sound barrier, it provides greater sound attenuation than the prior art use of insulation to the rear of the access panel because the gaps below the insulation curtain are closed.

While the invention has been specifically described in connection with certain specific embodiments thereof, it is to be understood that this is by way of illustration and not of limitation, and the scope of the appended claims should be construed as broadly as the prior art will permit.

What is claimed is:

1. A dishwasher comprising:

a wash tub comprising a rear wall, top wall, bottom wall, and side walls, with the walls collectively forming an open-faced wash chamber;

a support frame having a front-facing opening intermediate a support frame upper portion and a support frame lower portion, and the wash tub is mounted to the support frame such that the open-faced wash chamber is in communication with the front-facing opening, and a motor cavity with a front-facing motor cavity opening is defined intermediate the wash tub bottom wall and the support frame lower portion;

an insulation curtain extending along at least one side of the support frame and terminating at an edge adjacent the motor cavity; and a sound attenuator substantially closing the motor cavity opening and comprising a sound barrier element and a sound absorbing element, the sound absorbing element being a sheet-like body comprising a planar central portion extending along a bottom portion of the motor cavity to attenuate the sound emanated from the motor cavity, the sound absorbing element having at least one lateral wing portion hingedly attached to the central portion and extending along at least a portion of motor cavity sides, beyond the insulation curtain edge to overlap the insulation curtain to attenuate sound emanated from the motor cavity below the insulation curtain edge.

2. The dishwasher assembly of claim 1 wherein the sound barrier element comprises a sheet-like body.

3. The dishwasher assembly of claim 1 wherein the sound barrier element extends across the motor cavity opening.

4. The dishwasher assembly of claim 2 wherein the sound barrier element comprises a mass loaded vinyl.

5. The dishwasher assembly of claim 1 wherein the sound absorbing element comprises a fibrous polyester.

6. A dishwasher comprising:

a wash tub comprising a rear wall, top wall, bottom wall, and side walls, with the walls collectively forming an open-faced wash chamber;

a support frame having a front-facing opening intermediate a support frame upper portion and a support frame lower portion, and the wash tub is mounted to the support frame such that the open-faced wash chamber is in communication with the front-facing opening, and a motor cavity with a front-facing motor cavity opening is defined intermediate the wash tub bottom wall and the support frame lower portion; and a sound attenuator comprising a sound barrier element and a sound absorbing element, the sound absorbing element being a sheet-like body comprising a planar central portion adapted to be inserted into the motor cavity and at least one lateral wing portion hingedly attached to the central portion and adapted for vertical installation along the sides of the motor cavity, the sound attenuator substantially closing the motor cavity opening and extending along a bottom portion of the motor cavity to attenuate the sound emanated from the motor cavity.

7. The dishwasher assembly of claim 6 and further comprising an insulation curtain extending along at least one side of the support frame and terminating in an edge adjacent the motor cavity, and the wing portion extending beyond the edge portion to overlap the insulation curtain.

8. The dishwasher assembly of claim 6 wherein the sheet-like body comprises a front panel portion hingedly attached to the central portion and adapted for vertical installation in motor cavity opening.

9. The dishwasher assembly of claim 8 wherein the sound barrier element extends along the front panel portion.

10. The dishwasher assembly of claim 9 and further comprising at least one connector for attaching the sound baffler element to the front panel portion.

11. The dishwasher assembly of claim 10 wherein the at least one connector comprises at least one staple.

12. The dishwasher assembly of claim 10 wherein the at least one connector comprises an adhesive.

13. The dishwasher assembly of claim 9 and further comprising a access panel mounted to the support frame in overlying relationship with the sound barrier and the motor cavity opening.

14. A dishwasher comprising:

a wash tub comprising a rear wall, bottom wall, and side walls, with the walls collectively forming an open-faced wash chamber;

a support frame having a front-facing opening intermediate a support frame upper portion and a support frame lower portion, and the wash tub is mounted to the support frame such that the open-faced wash chamber is in communication with the front-facing opening, and a motor cavity with a front-facing motor cavity opening is defined intermediate the wash tub bottom wall and the support frame lower portion;

an access panel covering the motor cavity opening;

an insulation curtain extending along at least one side of the support frame and terminating at an edge adjacent the motor cavity; and a sound attenuator substantially closing the motor cavity opening and comprising a sound barrier element and a sound absorbing element, the sound absorbing element being a sheet-like body comprising a planar central portion extending along a bottom portion of the motor cavity to attenuate the sound emanated from the motor cavity, the sound absorbing element having at least one lateral wing portion hingedly attached to the central portion and extending along at least a portion of the motor cavity sides and beyond the insulation curtain edge to overlap the insulation curtain to attenuate the sound emanated from the motor cavity below the insulation curtain edge.

* * * * *